United States Patent [19]

McIntire et al.

[11] 4,088,113

[45] May 9, 1978

[54] WOOD BURNING AUTOMATIC SWIMMING POOL HEATER

[76] Inventors: Kendrick H. McIntire, Rte. 2, Box 1000; John E. McIntire, Rte. 2, Box 151-A, both of Aurora, Oreg. 97002

[21] Appl. No.: 710,441

[22] Filed: Aug. 2, 1976

[51] Int. Cl.[2] ..... F24B 9/04

[52] U.S. Cl. ..... 126/132; 236/45; 236/56

[58] Field of Search ..... 126/4, 5, 77, 132, 15 R; 110/72 R, 72 B; 236/45, 56

[56] References Cited

U.S. PATENT DOCUMENTS

| | | | |
|---|---|---|---|
| 1,125,183 | 1/1915 | Rymal | 126/5 |
| 1,189,261 | 7/1916 | Kincaid et al. | 126/5 |
| 2,388,829 | 11/1945 | Cheasley | 126/15 R |
| 2,414,147 | 1/1947 | Fleer | 126/15 R |
| 2,864,358 | 12/1958 | Harding | 126/15 R |

FOREIGN PATENT DOCUMENTS

| | | | |
|---|---|---|---|
| 1,089,341 | 9/1960 | Germany | 126/5 |

*Primary Examiner*—Ronald C. Capossela
*Attorney, Agent, or Firm*—Klarquist, Sparkman, Campbell, Leigh, Hall & Whinston

[57] ABSTRACT

A swimming pool heater has a fire chamber with a fuel feeding opening closable by a door which is removable to use the heater as a fireplace. A heat exchanger comprises a continuous length of copper tubing paralleled by an adjustable bypass. Air is supplied through a preheating manifold and regulated by a thermostatically controlled damper. A baffle delays escape of smoke and gases from the chamber.

7 Claims, 6 Drawing Figures

WOOD BURNING AUTOMATIC SWIMMING POOL HEATER

BACKGROUND OF THE INVENTION

In this age of dwindling natural resources, specifically oil, natural gas and electricity, the heating of swimming pools has become a major expense and many people have been looking for an alternative fuel for heating such pools. Also, due to the poluting nature of fosil fuels state after state is outlawing the use of such fuels for the heating of swimming pools. A wood-fueled swimming pool heater is a possible answer for some areas due to the fact that wood is a renewable resource and also considered a non-poluting fuel. However, due to the extra effort required to provide wood-fuel for such a heater and also due to the extra effort expended to fuel such a heater, not to mention cost, a way is needed to extract the full BTU value of such wood-fuel and also to regulate automatically its combustion so that the pleasure of having such a wood heated pool is not diminished by a constant need to tend the heater.

SUMMARY OF THE INVENTION

This invention is a wood-fueled automatic swimming pool heater. A swimming pool heater in itself is not unique and so it must be stated that what makes this invention unique is a combination of features, those being: a removable, airtight, fuel door which makes possible the conversion of pool heater into a wood burning fireplace. Other features used in combination with the airtight fuel door is an airtight combustion chamber used in conjunction with a pre-heated thermostatic draft. The airtight nature of this heater with thermostatic pre-heated draft maintains higher fire box temperatures and slows the exiting of the hot gases which, in turn, makes possible the heating of a much higher volume of water with very little fuel as compared with conventional methods or with any wood-fueled swimming pool heater without such features. Working in conjunction with the pre-heated thermostatic draft are two preheated secondary draft tubes which provide air to the upper part of the combustion chamber to promote the burning of otherwise wasted volatile wood gases. This invention also provides a baffle above the heat exchanger which further slows down the exiting of the hot air and gases unlike other swimming pool heaters which generally must allow for a quick escape of such resulting by-products of combustion. In addition to the above, this invention provides for a fast heat transfer of the trapped heat into the water through a specially designed fast flow heat exchanger which is able to accommodate the movement of more water through such exchanger and thus take advantage of the super-heated environment of the combustion area. Unlike other pool heat exchangers which use a cast header at each end, our heat exchanger operates without a header at either end, and thus allows for high volumes of water to pass through unrestricted. The heat exchanger is thus seen to be a continuous run of copper tubing, the smooth inner surface broken only by gradual curves contributing to no water turbulence and very little friction.

Another object of the invention is to provide a method whereby a swimming pool can be heated exclusive of electrical, oil or gas hook-ups which may be unavailable in certain areas.

The principal object of this invention is to provide an environment in the combustion chamber of superheated gases and radiation to heat a much greater volume of water with much less fuel and to heat it at a much faster rate than has been possible with oil, gas or electricity due to the fact that the latter methods pass the heated air past the heat exchanger at a fast rate thereby passing most of the heat out into the atmosphere rather than trapping it and holding it in the area of the heat exchanger. Also, this efficiency of our invention obviates the need to be constantly refueling the heater due to such fast depletion of fuel, and thus improve the pleasure derived from such reduced maintenance.

DESCRIPTION OF THE PREFERRED EMBODIMENT

Figure 1:
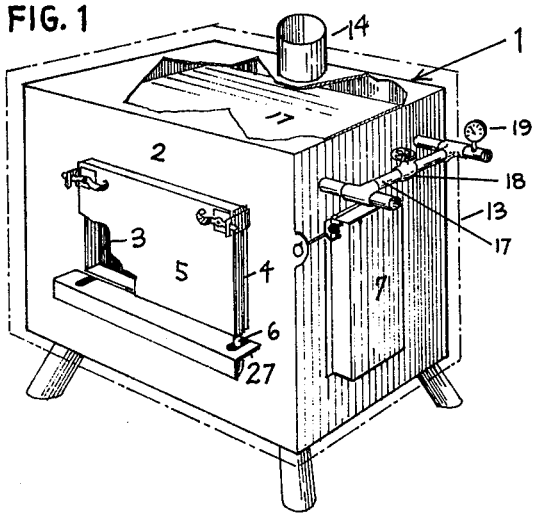
FIG. 1 is a perspective view of a wood-fueled automatic swimming pool heater forming one embodiment of the invention.

Referring now in detail to the several figures, the numeral 1 represents a wood-fueled, automatic swimming pool heater comprising a body 2 which, in the form shown, is rectangular, having a continuous side wall and a top and bottom. The body 2 has an opening 3 on the front for feeding fuel, the bottom of the opening being a considerable distance above the bottom of the heater. The opening 3 is framed about by an outwardly projecting jamb 4, having an opening in the front closed by an airtight fuel door 5. The fuel door is also instantly removable by virtue of its unique hinge mechanism comprised of two curved rods 6 which penetrate through the support flange 27 below.

Figure 4:
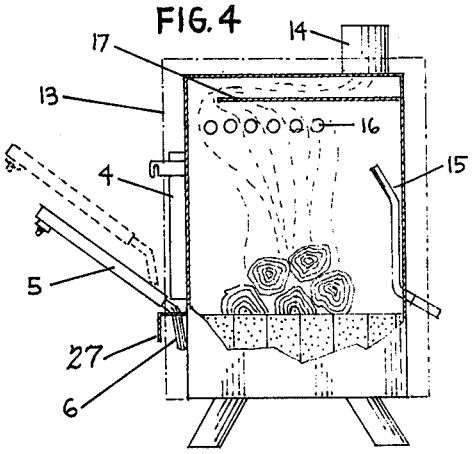
FIG. 4 is a partial, vertical, cross-section taken along the line 3—3 of FIG. 3.

FIG. 4 shows a view of the end of said fuel door in the opened position with the curved rods 6 penetrating the support flange 27 and resting against the body of the heater. The dotted line outline of said fuel door 5 (FIG. 4) illustrates the quick removal of the door.

Figure 2:
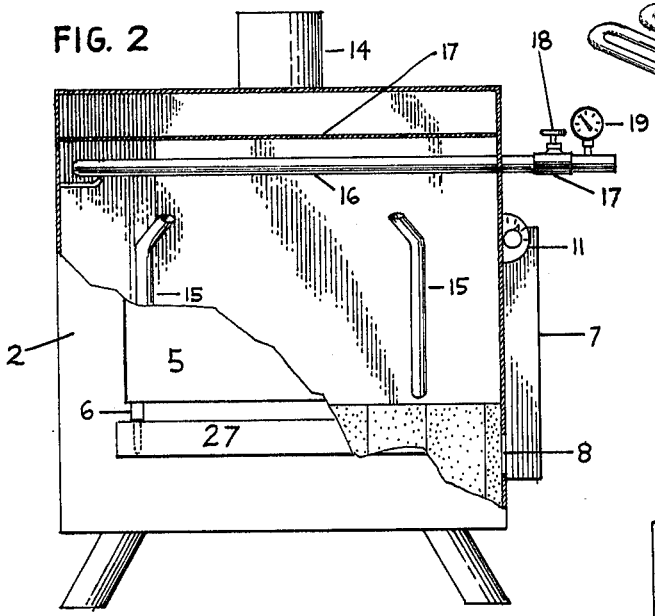
FIG. 2 is a partial, vertical, cross-section taken along the line of 2—2 of FIG. 3.
Figure 6:
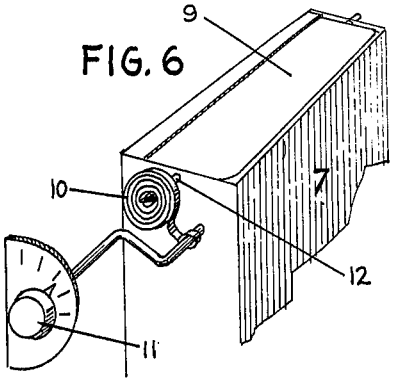
FIG. 6 is a perspective view of the automatic draft.
Figure 3:
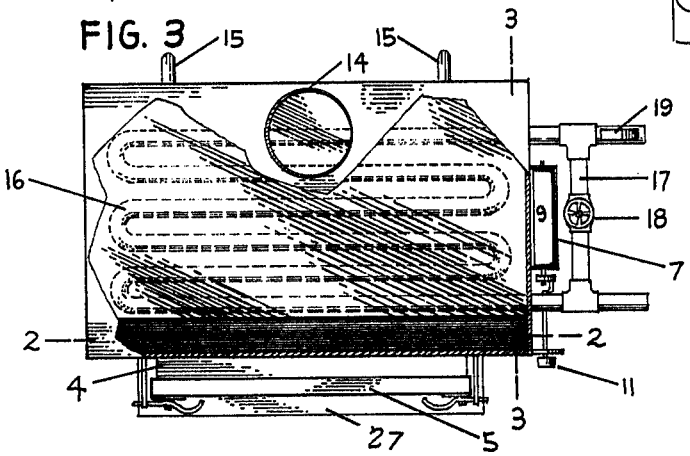
FIG. 3 is a plan view with the top partially cut away exposing the heat exchanger.

A down draft pre-heating manifold 7 (FIG. 2) is attached to the end of the body 2 and communicates with the lower part of the fuel chamber by means of a rectangular opening 8. A damper 9 (FIG. 6) is mounted in the upper portion of the down draft manifold and controls the draft to the fuel chamber. The damper 9 is operated by a thermostat comprising a bi-metallic spring 10 connected to one end to an adjusting knob 11, and the other end to the shaft of the damper 12, said coil being so arranged that as it heats it moves the damper 9 in a closing direction.

The body 2 is surrounded by a casing 13 indicated by broken lines in FIG. 1 and spaced out from the body 2 sufficient to accommodate a layer of insulation.

The top of the body 2 has an opening 14 near the back to receive the chimney stack pipe (not shown).

The back of the body 2 has two secondary pre-heating draft tubes 15 admitting air at a level above the primary fire zone. This air is admitted at all times by virtue of the pull or suction from draft vacuum. The area of the secondary air inlet or draft tubes 15 is much smaller than the volume of the primary draft inlet or pre-heating manifold 7 and so have little effect upon combustion during higher firing combustion conditions. The purpose of said secondary draft tubes 15 is to promote the combustion of wood gases under lower firing combustion conditions or when there is not sufficient oxygen entering the pre-heating manifold 7 due to the adjusting knob 11 being set at a low setting and, therefore, all available oxygen being burned in the primary fire or in the lower part of the combustion chamber.

Figure 5:
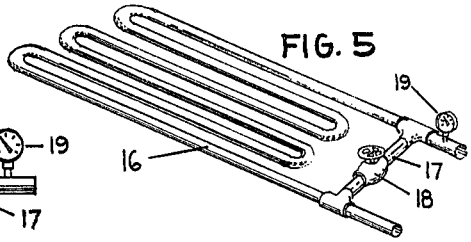
FIG. 5 is a perspective view of the heat exchanger.

FIG. 5 shows the heat exchanger 16 which is a continuous copper tube formed in a configuration of several loops allowing quite a length of heat exchanging surface in the relatively small space in which it must be accommodated in the upper portion of the body 2 or in the upper part of the combustion chamber. Immediately above the heat exchanger is a baffle 17 which attaches tightly to three surfaces of the inside body 2 or combustion chamber except for a small space toward the front of the body 2. This small space is about equal to the volume of the chimney stack pipe 14. The upper area thus communicates with the combustion area below said baffle 17 by reason of said space.

Connecting the two terminal ends of the heat exchanger 16 is a manual by-pass 17 comprising a tube equal in volume to the heat exchanger tube 16 and a gate valve 18 mounted in the center between the terminal ends. Mounted in the return end terminal of the heat exchanger is a water temperature gauge 19 which permits the operator to determine the amount of water which shall bypass the heat exchanger 16 by adjusting gate valve 18 to attain optimum efficiency of the heat exchanger 16.

What we claim is:

1. A wood-fueled, automatic heater comprising:

a body having a surrounding side wall, top and bottom, defining in the lowermost portion thereof a fuel combustion chamber, a pre-heating down draft manifold communicating with said fuel chamber combustion chamber with inlet adjacent to the lower part of said body, a damper in the upper part of said down draft manifold, a thermostat so mounted as to respond predominantly to heater temperature for moving said damper in closing direction as heater temperature rises, said manifold heating air as it moves in a downward direction toward the primary combustion area, draft tubes mounted to the upper rear wall of body extending inwardly and upwardly toward the upper area of the fuel combustion chamber admitting air under all combustion conditions and presenting portions thereof to the combustion area to cause a preheating of said secondary air tubes and thus a pre-heating of entering secondary air, a flat, horizontal heat exchanger in the upper portion of the body and spaced downwardly from the top, a baffle positioned just above the heat exchanger and immediately below the inside upper portion of the body and attached to the body on three sides leaving a space for escaping smoke and gases toward the front of the chamber in effect trapping and holding the combustion process and resulting hot gases and radiated heat and confining and holding such gases and heat in the area of the heat exchanger for a longer time than ordinarily possible, and a collar on the upper rear portion of the body to accept a smoke pipe.

2. The wood-fueled, automatic heater as claimed in claim 1, said body having an instantly removable fuel door on the front of the body, said door being airtight fitted with airtight gasket, said door including curved rods penetrating a support flange of said body, said door being adapted to be locked in place with double latches on the upper corners of said door, said door being removable by lifting it in an upward direction to reveal an open fire, thereby providing optional usage of said heater as an open fireplace.

3. The wood-fueled automatic heater as claimed in claim 1, said heat exchanger being of fast flow design and including a manual bypass and temperature gauge.

4. The heater of claim 1 wherein the body has a door opening, and including a door releasably secured to the body to form a heater therewith when closed and a fireplace when open.

5. In a heater, a hollow heater body including a front wall having a door opening and also having a bottom, top, side walls and back wall, draft means for introducing air into the lower portion of the body to support combustion in the lower portion, a baffle in the upper portion of the body extending from the back wall to a point near to but spaced from the front wall, a flat, horizontal heat exchanger in the upper portion of the body just below the baffle, flue outlet means in the body near the back thereof and adapted to receive flue gases passing over the top of the baffle, and door means attached to the body for closing the opening to form a stove and removable from the opening to convert the body to a fireplace.

6. The heater of claim 5 wherein the door is hinged to the body.

7. The heater of claim 5 including secondary air heating and supplying tubes extending into the body at the lower portion thereof and upwardly into the body toward the heat exchanger.

* * * * *